US006161833A

United States Patent [19]

Gomez

[11] Patent Number: 6,161,833

[45] Date of Patent: Dec. 19, 2000

[54] WASHER TOSSING GAME

[76] Inventor: Jose H. Gomez, 5305 Jaine La., Austin, Tex. 78721

[21] Appl. No.: 09/314,913

[22] Filed: May 20, 1999

[51] Int. Cl.[7] ..... A63B 67/06

[52] U.S. Cl. ..... 273/400

[58] Field of Search ..... 273/398, 400, 273/402, 126 R, 126 F, 127 R, 127 B, 173, 174, 195

[56] References Cited

U.S. PATENT DOCUMENTS

| | | | |
|---|---|---|---|
| 324,189 | 8/1885 | Thomas | 273/400 |
| 972,597 | 10/1910 | Byl | 273/126 R |
| 4,989,880 | 2/1991 | Gettemeier et al. | 273/400 X |
| 5,056,797 | 10/1991 | Hockert et al. | 273/402 |
| 5,060,955 | 10/1991 | Bible | 273/400 |
| 5,351,968 | 10/1994 | Starnes | 273/400 X |
| 5,533,734 | 7/1996 | Husk | 273/402 |
| 5,553,862 | 9/1996 | Konotopsky | 273/402 |
| 5,882,010 | 3/1999 | Geror | 273/400 |

FOREIGN PATENT DOCUMENTS

| | | | |
|---|---|---|---|
| 494672 | 3/1930 | Germany | 273/400 |

*Primary Examiner*—Raleigh W. Chiu

[57] ABSTRACT

A washer tossing game for tossing washers at a target and scoring points based on how close the washer is tossed to the center of the target. The washer tossing game includes a mat with a center hole at the center of the mat. An upper surface of the mat has a plurality of concentric scoring rings displayed thereon around the center hole of the mat including an inner scoring ring and an outer scoring ring. A plurality of annular washers are provided divided into a plurality of sets. The mat is rested on a surface such that the upper face of the mat faces upwards. The players then take alternating turns tossing a washer from their set of washers at the mat. Points are awarded from washers that land in the center cup, the inner scoring ring and the outer scoring ring.

9 Claims, 1 Drawing Sheet

WASHER TOSSING GAME

BACKGROUND OF THE INVENTION

1. Field of the Invention

The present invention relates to washer tossing games and more particularly pertains to a new washer tossing game for tossing washers at a target and scoring points based on how close the washer is tossed to the center of the target.

2. Description of the Prior Art

The use of washer tossing games is known in the prior art. More specifically, washer tossing games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,936,590; U.S. Pat. No. 4,982,966; U.S. Pat. No. Des. 317,12; U.S. Pat. No. 4,974,858; U.S. Pat. No. 5,040,801; and U.S. Pat. No. 4,736,955.

While these devices fulfill their respective, particular objectives and requirements, the aforementioned patents do not disclose a new washer tossing game. The inventive device includes a mat with a center hole at the center of the mat. An upper surface of the mat has a plurality of concentric scoring rings displayed thereon around the center hole of the mat including an inner scoring ring and an outer scoring ring. A plurality of annular washers are provided divided into a plurality of sets. The mat is rested on a surface such that the upper face of the mat faces upwards. The players then take alternating turns tossing a washer from their set of washers at the mat. Points are awarded from washers that land in the center cup, the inner scoring ring and the outer scoring ring.

In these respects, the washer tossing game according to the present invention substantially departs from the conventional concepts and designs of the prior art, and in so doing provides an apparatus primarily developed for the purpose of tossing washers at a target and scoring points based on how close the washer is tossed to the center of the target.

SUMMARY OF THE INVENTION

In view of the foregoing disadvantages inherent in the known types of washer tossing games now present in the prior art, the present invention provides a new washer tossing game construction wherein the same can be utilized for tossing washers at a target and scoring points based on how close the washer is tossed to the center of the target.

The general purpose of the present invention, which will be described subsequently in greater detail, is to provide a new washer tossing game apparatus and method which has many of the advantages of the washer tossing games mentioned heretofore and many novel features that result in a new washer tossing game which is not anticipated, rendered obvious, suggested, or even implied by any of the prior art washer tossing games, either alone or in any combination thereof.

To attain this, the present invention generally comprises a mat with a center hole at the center of the mat. An upper surface of the mat has a plurality of concentric scoring rings displayed thereon around the center hole of the mat including an inner scoring ring and an outer scoring ring. A plurality of annular washers are provided divided into a plurality of sets. The mat is rested on a surface such that the upper face of the mat face 5. upwards. The players then take alternating turns tossing a washer from their set of washers at the mat. Points are awarded from washers that land in the center cup, the inner scoring ring and the outer scoring ring.

There has thus been outlined, rather broadly, the more important features of the invention in order that the detailed description thereof that follows may be better understood, and in order that the present contribution to the art mat be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based. may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new washer tossing game apparatus and method which has many of the advantages of the washer tossing games mentioned heretofore and many novel features that result in a new washer tossing game which is not anticipated, rendered obvious, suggested, or even implied by any of the prior art washer tossing games, either alone or in any combination thereof.

It is another object of the present invention to provide a new washer tossing game which may be easily and efficiently manufactured and marketed.

It is a further object of the present invention to provide a new washer tossing game which is of a durable and reliable construction.

An even further object of the present invention is to provide a new washer tossing game which is susceptible of a low cost of manufacture with regard to both materials and labor, and which accordingly is then susceptible of low prices of sale to the consuming public, thereby making such washer tossing game economically available to the buying public.

Still yet another object of the present invention is to provide a new washer tossing game which provides in the apparatuses and methods of the prior art some of the advantages thereof, while simultaneously overcoming some of the disadvantages normally associated therewith.

Still another object of the present invention is to provide a new washer tossing game for tossing washers at a target and scoring points based on how close the washer is tossed to the center of the target.

Yet another object of the present invention is to provide a new washer tossing game which includes a mat with a center hole at the center of the mat. An upper surface of the mat has a plurality of concentric scoring rings displayed thereon around the center hole of the mat including an inner scoring ring and an outer scoring ring. A plurality of annular washers are provided divided into a plurality of sets. The mat is rested on a surface such that the upper face of the mat faces upwards. The players then take alternating turns tossing a washer from their set of washers at the mat. Points are awarded from washers that land in the center cup, the inner scoring ring and the outer scoring ring.

Still yet another object of the present invention is to provide a new washer tossing game that may be played indoors and outdoors and without the need for digging holes in the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
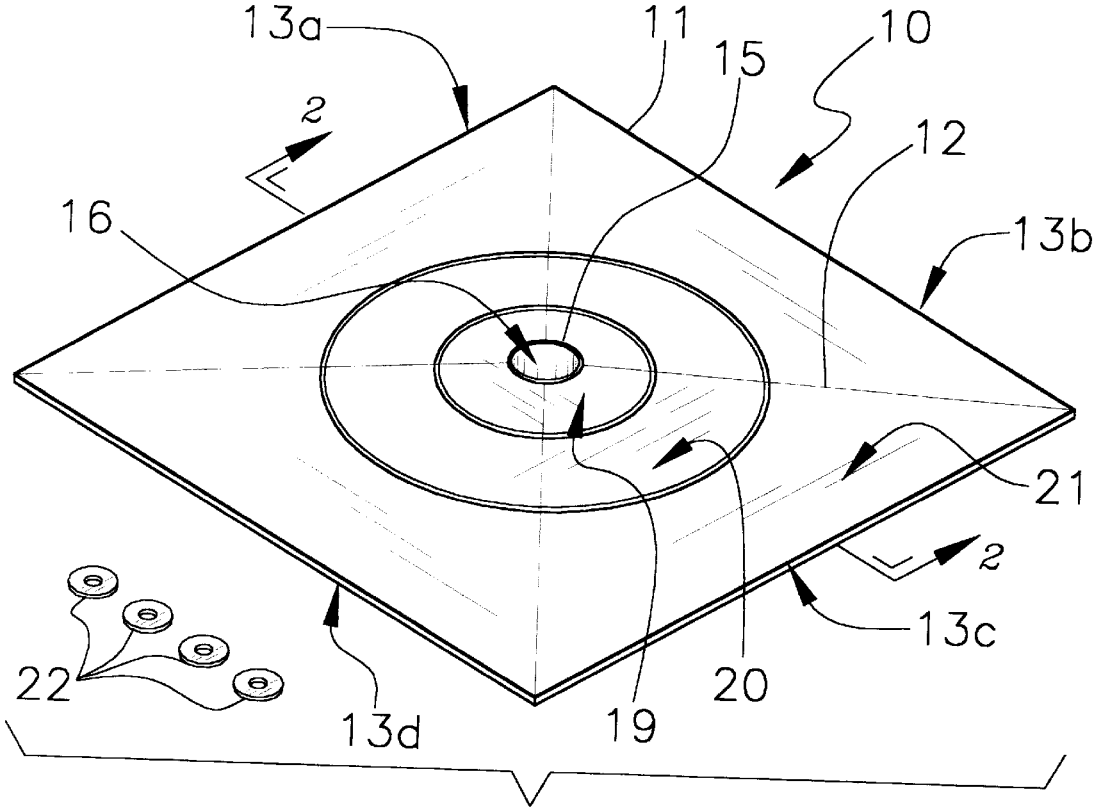
FIG. 1 is a schematic perspective view of components of a new washer tossing game according to the present invention.
Figure 2:
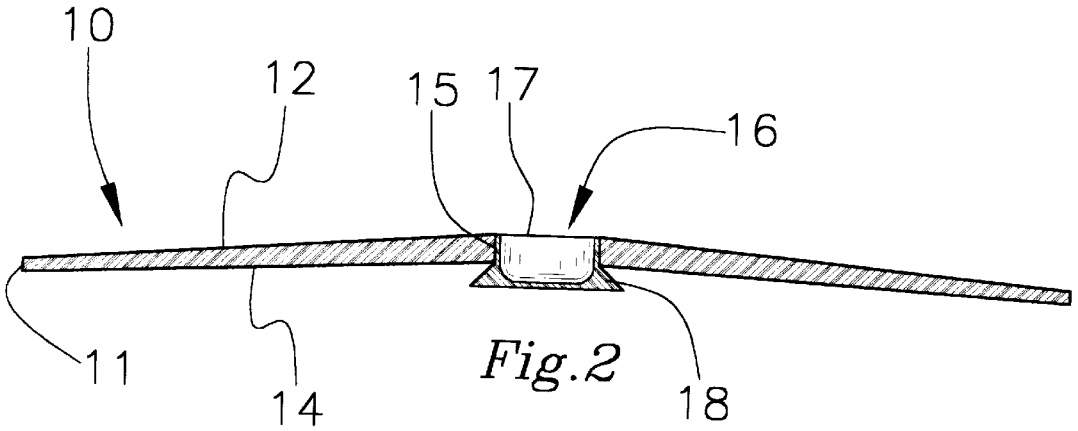
FIG. 2 is a schematic cross sectional view of the mat taken from line 2—2 of FIG. 1.

With reference now to the drawings, and in particular to FIGS. 1 through 2 thereof, a new washer tossing game embodying the principles and concepts of the present invention will be described.

As best illustrated in FIGS. 1 through 2, the washer tossing game generally comprises a mat with a center hole at the center of the mat. An upper surface of the mat has a plurality of concentric scoring rings displayed thereon around the center hole of the mat including an inner scoring ring and an outer scoring ring. A plurality of annular washers are provided divided into a plurality of sets. The mat is rested on a surface such that the upper face of the mat faces upwards. The players then take alternating turns tossing a washer from their set of washers at the mat. Points are awarded from washers that land in the center cup, the inner scoring ring and the outer scoring ring.

In closer detail, the washer tossing game includes a generally square mat 10 for resting on a ground surface having a center, a generally rectangular outer perimeter 11 comprising four substantially equal length sides, and a generally frustum shaped upper surface 12 comprising four generally triangular regions 13*a*,13*b*,13*c*,13*d* converging at the center of the mat, and a substantially planar bottom surface 14. The mat also has a generally circular center hole 15 therethrough at the center of the mat.

Preferably, as best illustrated in FIG. 2, a generally cylindrical center cup 16 is inserted into the center hole of the main. The center cup has an upwardly facing open top 17, and a generally frusta-conical base 18 positioned beneath the center of the mat. In use, the base of the center cup is designed for upwardly raising the center of the mat above the ground surface on which the mat rests.

As illustrated in FIG. 1, the upper surface of the mat has a plurality of concentric scoring rings displayed thereon around the center hole of the mat. The plurality of concentric scoring rings includes an inner scoring ring 19 adjacent the center hole and an outer scoring ring 20 defining an outer periphery of the plurality of concentric scoring rings. Each of the scoring rings has portions located in each of the generally triangular regions of the upper surface of the mat. Ideally, the inner and outer scoring rings are colored different visibly detectable colors from one another so that the inner and outer scoring rings are easily visibly distinguishable from one another.

The outer periphery of the plurality of concentric scoring rings is spaced apart from the outer perimeter of the mat to define therebetween an outer area 21 on the upper surface.

Ideally, the mat is substantially square and has equal width and length defined across the outer perimeter each about 30 inches to provide a sufficient area for tossing washers at while still maintaining a challenging game for users with a range of skill in tossing washers. In this ideal embodiment, the mat has a thickness defined between the upper and lower surfaces of the mat tapering from about ½ inch thick adjacent the center of the mat to about ¼ inch thick at the outer perimeter of the mat to define the frustum shape of the upper surface. Furthermore, the center hole ideally has an outer diameter of about 3½ inches with the open top of the center cup has a diameter slightly less than the outer diameter of the center hole and no less than about 3 inches. The inner scoring ring ideally has an outer diameter of about 8¼ inch and the outer scoring ring has an outer diameter of about 18 inches for providing a sufficient area for scoring in the center cup and scoring rings while still maintaining a challenging game for users with a range of skill in tossing washers.

The mat preferably comprises a resiliently deformable flexible material such as a flexible rubber or plastic material to permit rolling up of the mat when not in use for convenient storage and transport. Also preferably, the cup comprises a rigid material such as a rigid plastic material for durability and lightness of weight.

A plurality of annular washers 21 divided into a plurality of sets are also provided. Each set of washers preferably comprises four washers. Even more preferably, the plurality of sets of washers comprises four sets. Each set of washers is ideally colored a visibly distinguishable color from the washers of the other sets so that each set is distinguishable from the other sets. In the ideal embodiment, each washer preferably has an outer diameter of about 2¾ inches to permit tossing of the washers into the open top of the center cup.

In use, the game is played by first providing a plurality of players. Ideally, the plurality of players comprises between 2 and four players. The mat is rested on a ground or floor surface such that the upper face of the mat faces upwards. Each player is assigned one of the sets of washers. The players then toss one of their set of washers in alternating turns at the upper face of the mat from a predetermined distance away from the outer perimeter of the mat.

A first predetermined number of points is award to a player who tosses a washer into the open top of the center cup. Preferably, the first predetermined number of points equals 5 points. A second predetermined number of points is awarded to a player who tosses a washer onto the inner scoring ring. Preferably, the second predetermined number of points equals 3 points. A third predetermined number of points is awarded to a player who tosses a washer onto the outer scoring ring. In the preferred embodiment, the third predetermined number of points equals 1 point. Preferably, zero points are awarded to a player who tosses a washer onto the outer area of the mat.

A winner is declared as the first player awarded a sum of points totaling a predetermined victory score. Ideally, the victory score equals 21 points to keep the game playable in less than an hour and so that several games can be played in a short period of time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a washer tossing game, comprising the acts of:

providing a mat having a center, an outer perimeter, and an upper surface;

said mat having a center hole at said center of said mat;

said upper surface of said mat having a plurality of concentric scoring rings displayed thereon around said center hole of said mat, said plurality of concentric scoring rings including an inner scoring ring adjacent said center hole and an outer scoring ring defining an outer periphery of said plurality of concentric scoring rings;

providing a plurality of annular washers divided into a plurality of sets;

providing a plurality of players;

resting said mat on a surface such that said upper face of said mat faces upwards;

assigning each player one of said sets of washers;

tossing said washers at said upper face of said mat from a predetermined distance away from said outer perimeter of said mat with each player performing alternating tosses;

awarding a first predetermined number of points to a player who tosses a washer into said center hole;

awarding a second predetermined number of points to a player who tosses a washer onto said inner scoring ring;

awarding a third predetermined number of points to a player who tosses a washer onto said outer scoring ring;

declaring a winner as the first player awarded a sum of points totaling a predetermined victory score; and said upper surface of said mat being generally frustum-shaped and comprising four generally triangular regions converging at said center of said mat.

2. The method of claim 1, wherein each set of washers comprises four washers.

3. The method of claim 1, wherein said first predetermined number of points equals 5 points, wherein said second predetermined number of points equals 3 points, and wherein said third predetermined number of points equals 1 point.

4. The method of claim 3, wherein said victory score equals 21 points.

5. A method of playing a washer tossing game, comprising the acts of:

providing a generally rectangular mat;

said mat having a center, a generally rectangular outer perimeter, and a generally frustum shaped upper surface comprising four generally triangular regions converging at said center of said mat;

said mat having a center hole therethrough at said center of said mat;

a generally cylindrical center cup being inserted into said center hole of said main, said center cup having an upwardly facing open top, and a generally frusta-conical base positioned beneath said center of said mat;

said upper surface of said mat having a plurality of concentric scoring rings displayed thereon around said center hole of said mat, said plurality of concentric scoring rings including an inner scoring ring adjacent said center hole and an outer scoring ring defining an outer periphery of said plurality of concentric scoring rings;

said outer periphery of said plurality of concentric scoring rings being spaced apart from said outer perimeter of said mat;

said upper surface of said mat having an outer area defined between said outer periphery of said plurality of concentric scoring rings and said outer perimeter of said mat;

providing a plurality of annular washers divided into a plurality of sets, each set of washers comprising four washers;

providing a plurality of players;

resting said mat on a surface such that said, upper face of said mat faces upwards;

assigning each player one of said sets of washers;

tossing said washers at said upper face of said mat from a predetermined distance away from said outer perimeter of said mat with each player performing alternating tosses;

awarding a first predetermined number of points to a player who tosses a washer into said open top of said center cup, wherein said first predetermined number of points equals 5 points;

awarding a second predetermined number of points to a player who tosses a washer onto said inner scoring ring, wherein said second predetermined number of points equals 3 points;

awarding a third predetermined number of points to a player who tosses a washer onto said outer scoring ring, wherein said third predetermined number of points equals 1 point;

awarding zero points to a player who tosses a washer onto said outer area of said mat; and declaring a winner as the first player awarded a sum of points totaling a predetermined victory score, wherein said victory score equals 21 points.

6. A method of playing a washer tossing game, comprising the acts of:

providing a mat having a center, an outer perimeter, and an upper surface;

said mat having a center hole at said center of said mat;

said upper surface of said mat having a plurality of concentric scoring rings displayed thereon around said center hole of said mat, said plurality of concentric scoring rings including an inner scoring ring adjacent said center hole and an outer scoring ring defining an outer periphery of said plurality of concentric scoring rings;

providing a plurality of annular washers divided into a plurality of sets;

providing a plurality of players;

resting said mat on a surface such that said upper face of said mat faces upwards;

assigning each player one of said sets of washers;

tossing said washers at said upper face of said mat from a predetermined distance away from said outer perimeter of said mat with each player performing alternating tosses;

awarding a first predetermined number of points to a player who tosses a washer into said center hole;

awarding a second predetermined number of points to a player who tosses a washer onto said inner scoring ring;

awarding a third predetermined number of points to a player who tosses a washer onto said outer scoring ring;

declaring a winner as the first player awarded a sum of points totaling a predetermined victory score;

providing a center cup, said center cup being inserted into said center hole of said main, said center cup having an upwardly facing open top, wherein said first predetermined number of points is award to a player who tosses a washer into said open top of said center cup; and said center cup having a generally frusta-conical base positioned beneath said center of said mat.

7. The method of claim 6, wherein each set of washers comprises four washers.

8. The method of claim 6, wherein said first predetermined number of points equals 5 points, wherein said second predetermined number of points equals 3 points, and wherein said third predetermined number of points equals 1 point.

9. The method of claim 8, wherein said victory score equals 21 points.

* * * * *